United States Patent [19]

Johnson

[11] 4,108,515

[45] Aug. 22, 1978

[54] DISPLAY CASE

[76] Inventor: Raymond M. Johnson, 1029 Donaldson Ave., San Antonio, Tex. 78228

[21] Appl. No.: 731,311

[22] Filed: Oct. 12, 1976

[51] Int. Cl.[2] ..... A47F 3/14

[52] U.S. Cl. ..... 312/119; 312/126; 312/127; 211/151; 211/162

[58] Field of Search ..... 312/119, 126, 127, 218, 312/301, 308; 292/347; 211/151, 162

[56] References Cited

U.S. PATENT DOCUMENTS

| | | | |
|---|---|---|---|
| 480,693 | 8/1892 | Foster et al. | 211/151 |
| 1,009,755 | 11/1911 | Lange | 312/127 |
| 1,098,994 | 6/1914 | Tawney | 312/126 |
| 1,626,013 | 4/1927 | Sherer | 312/126 |
| 1,672,633 | 6/1928 | Vogel | 312/126 |
| 1,693,980 | 12/1928 | Gale | 312/122 |
| 2,955,858 | 10/1960 | Trammell, Jr. | 292/347 |
| 3,259,443 | 7/1966 | Lavigne et al. | 312/126 |
| 3,465,894 | 9/1969 | Setecka | 211/151 |
| 3,554,625 | 1/1971 | Sly, Sr. | 312/126 |
| 3,883,004 | 5/1975 | Slaga | 211/162 |

*Primary Examiner*—Mervin Stein
*Assistant Examiner*—Victor N. Sakran
*Attorney, Agent, or Firm*—Cox, Smith, Smith, Hale & Guenther Incorporated

[57] ABSTRACT

The present invention is an enclosed display case having slidable trays therein movable from the outside of the display case. The slidable trays are stacked either vertically or horizontally with the items contained thereon being visible through a locked sliding glass door of the display case. Each of the trays has rollers to aid the movement of the trays along grooves inside the display case. Knobs extend from the side of the trays through slots to the outside of the display case to allow movement of the trays by customers to view items contained on each tray. A three-fourths length thin sliding bar moves with each tray to cover the slots in the side of the display case thereby preventing pilferage through the slots by customers.

6 Claims, 9 Drawing Figures

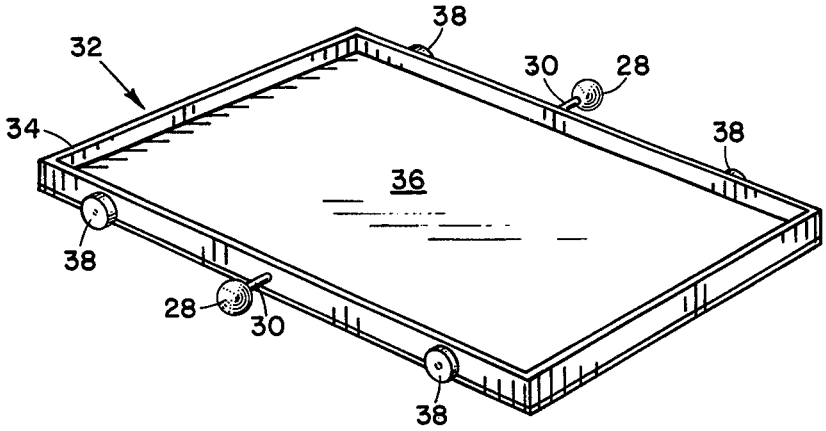
FIG. 6
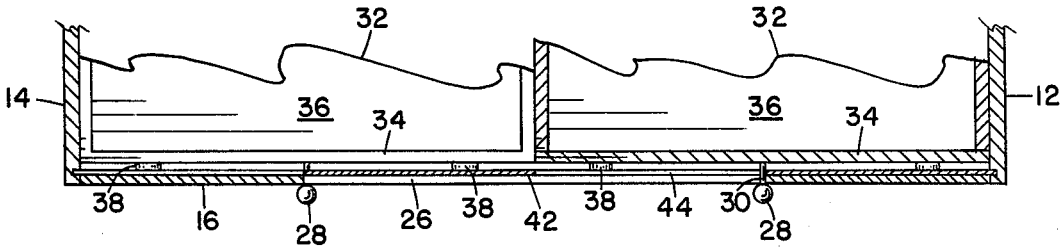
FIG. 5
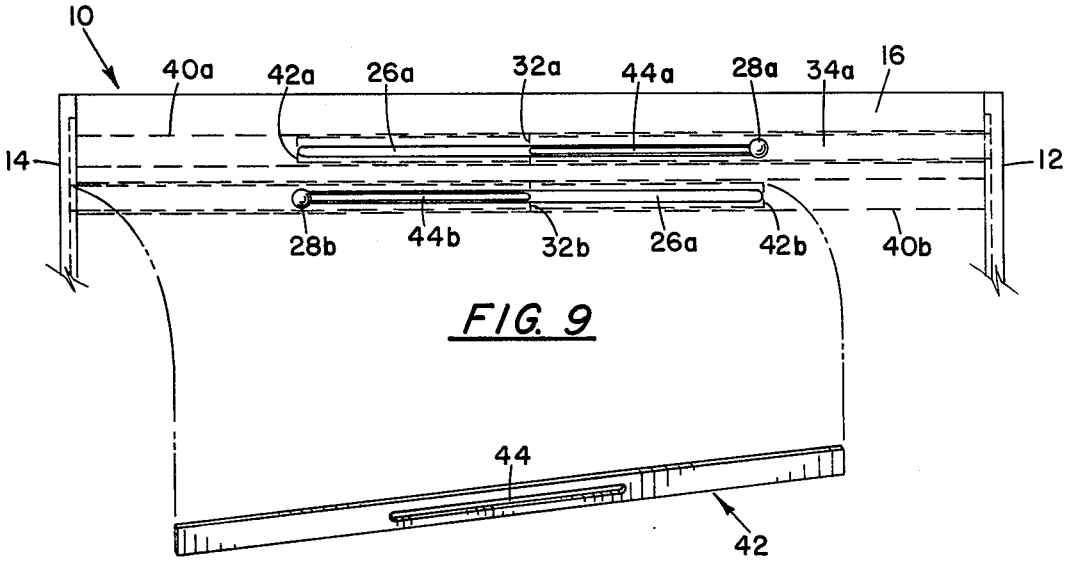
FIG. 9
FIG. 4

DISPLAY CASE

BACKGROUND OF THE INVENTION

This invention relates to a display case and, more particularly, to a totally enclosed display case having a locked slidable viewing door through which a customer can view the items contained on trays inside the display case. Each of the trays are movable by the customer by means of knobs extending external to the display case through slots in the side. A thin sliding bar is contained in each slot of the display case to prevent pilferage therethrough.

BRIEF DESCRIPTION OF THE PRIOR ART

Prior to the present invention, many different types of display devices have been devised and used by merchants both retail and wholesale. The most typical type of display case used by retail merchants is an enclosed glass counter having shelves therein. The glass counter would normally be locked if it contained more expensive items. Also, if the shelves were very close together, a sales person would have had to unlock the display counter and physically remove the items for viewing by the customer. If all of the items inside the glass display counter were visible by the customer, there would be a considerable loss of display space inside the glass counter.

If a merchant desires to utilize his space to a maximum to contain the largest possible number of items, open shelves with various items stacked thereon become the logical answer. However, by use of open shelves, pilferage and theft become a significant problem. Therefore, sales personnel would have to continually watch prospective customers to prevent such pilferage and theft.

To utilize the space in a store to the maximum with a minimum amount of sales personnel, and allow customers to browse through numerous items in a well-stocked store, some other type of display arrangement has become essential. While many different types of display cases and security devices have been designed and used in the past, they still have not satisfied the problem of a store with (1) a minimum of sales personnel, (2) a maximum stock of items for sale, and (3) a minimum space for displaying the stock. It is essential that the customer be able to view the stock while eliminating the potential for pilferage and theft.

SUMMARY OF THE INVENTION

The display case has a slidable locked glass viewing door or window that may be opened by the sales personnel upon request for a closer view or purchase or a particular item contained in the display case. Slidable trays that have a knob extending through a slot in the side of the display case may be used to move the trays contained therein so that all of the items contained on each tray may be clearly viewed by the prospective customer. The trays may be stacked in a vertical or horizontal position, depending upon the particular requirements of the merchant. Each of the trays are mounted inside of grooves cut in the cabinets with rollers supporting the trays for ease of movement. A thin sliding bar may be contained in each of the grooves and be movable with each of the trays to prevent pilferage via slots through which the knobs extend. The trays may be mounted horizontally with the knobs extending through each side of the display case, or the trays may be mounted vertically with the knobs extending from one side under or above each of the trays.

BRIEF DESCRIPTION OF THE DRAWINGS

FIG. 4 is a perspective view of the thin sliding bar shown in FIG. 3.

FIG. 5 is a partial sectional view of FIG. 1 along section lines 5—5.

FIG. 6 is a perspective view of a tray used in the display case of FIG. 1.

FIG. 9 is a partial elevated view of FIG. 1.

DESCRIPTION OF THE PREFERRED EMBODIMENT

Figure 1:
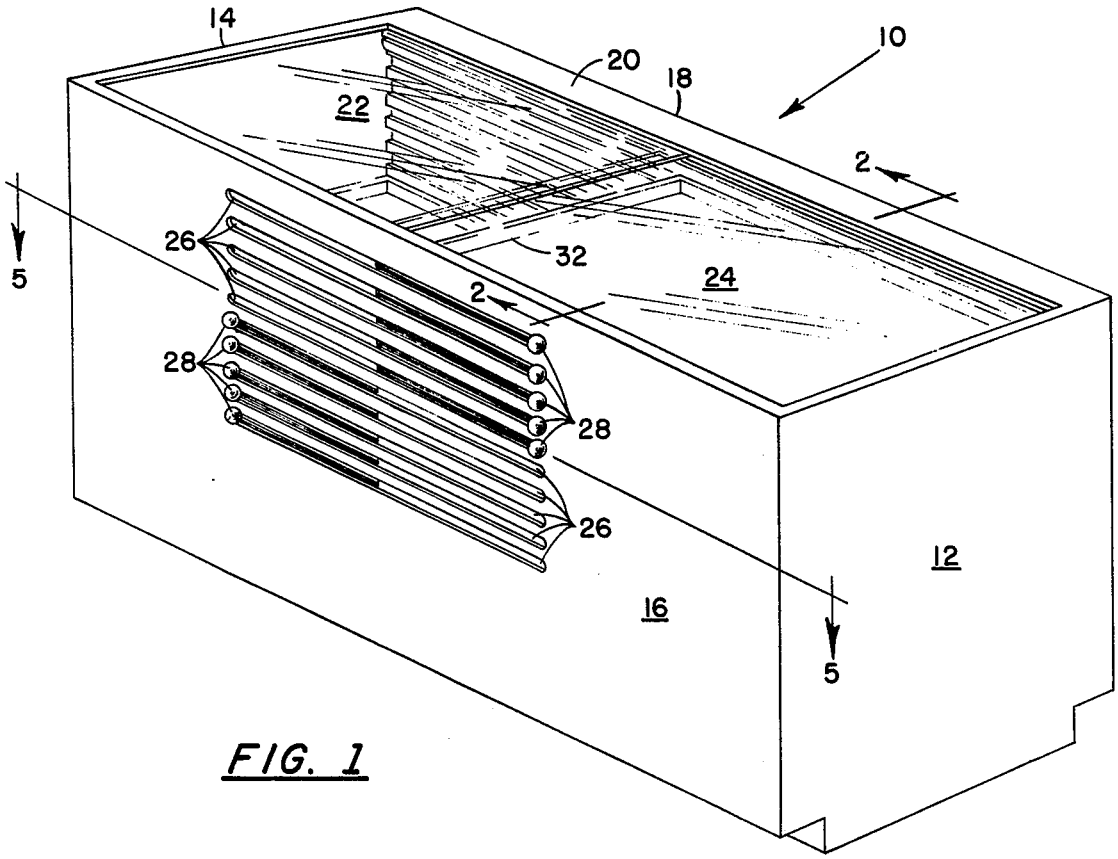
FIG. 1 is a perspective view of a horizontal display cabinet embodying the present invention.

Referring now to FIG. 1 of the drawings, there is shown a display case represented generally by the reference numeral 10. The display case 10 has end walls 12 and 14, and side walls 16 and 18. Along the top of side wall 18 is located a top strip 20 that fastens to sliding glass tops 22 and 24. The sliding glass tops 22 and 24 may be secured in the closed position by a suitable locking mechanism.

Figure 2:
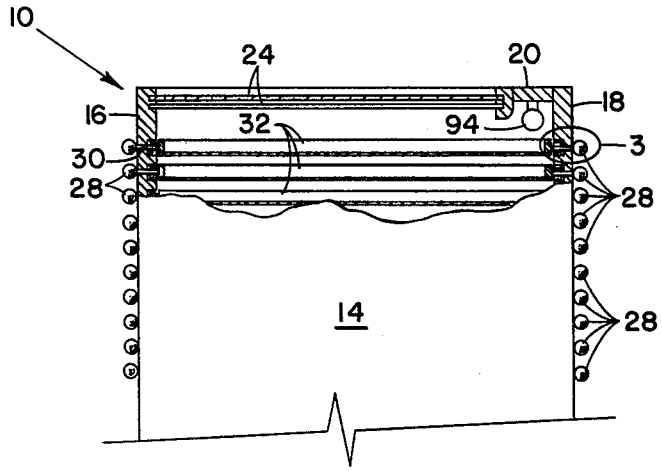
FIG. 2 is a partial cross sectional view of FIG. 1 along section lines 2—2.
Figure 3:
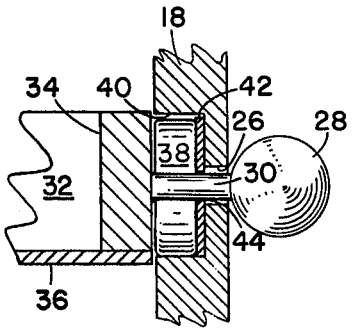
FIG. 3 is an enlarged view of the portion of FIG. 2 in circle 3.

In each side wall 16 and 18 are located a series of parallel slots 26 with knobs 28 extending therethrough. Referring to FIGS. 2 and 3 in combination with FIG. 1, a better understanding of the construction of the display case 10 can be obtained. Each of the knobs 28 connect by means of a shaft 30 through slot 26 to tray 32 via frame 34. The frame 34 supports the bottom 36 of the tray 32. On each end of each side of the tray 32 are mounted rollers 38 (which can be more clearly seen in FIG. 6), which rollers 38 are located inside of grooves 40 of the side walls 16 and 18. The rollers 38 allow for ease of movement of tray 32 by means of the knobs 28.

Referring now to FIGS. 3, 4, 5 and 9 in combination, further description hereinafter will explain the use of thin sliding bars 42 inside of grooves 40 to prevent pilferage or theft through parallel slots 26. The thin sliding bars 42, as can be seen in FIG. 3, are located adjacent to the rollers 38 around shafts 30 and abutting the innermost portion of grooves 40. The thin sliding bars 42 are three-fourths the length of display case 10 with the slot 44 contained therein being one-half the length of slot 26. In other words, the slot 44 of the thin sliding bars 42 is one-fourth the length of grooves 40. A perspective view of the thin sliding bars 42 is provided in FIG. 4.

Referring to FIGS. 5 and 9 in combination, the use of the thin sliding bars 42 to prevent pilferage and theft can be better understood. In FIG. 9, tray **32*a* is located immediately adjacent to end wall 12. Tray 32*b* is located adjacent to end wall 14. Both trays 32*a* and 32*b* are represented in dotted lines in FIG. 9. Assume that small valuable items, such as diamond rings, are contained in tray 32*b*. A customer at the store, even though the sliding glass tops 22 and 24 are securely locked closed, may extend his fingers, or some type of hooking device, through slot 26a to steal diamond rings out of tray 32b. However, by using the thin sliding bars 42 that may freely slide inside of grooves 40 with movement of trays 32, the thin sliding bar 42a covers the portion of the slot 26a that extends over trays 32b. Places where slot 44a of thin sliding bar 42a are in alignment with slot 26a will be protected against pilferage by the side 34a of tray 32a. By movement of the tray 32a to the left-hand side adjacent wall 14, the thin sliding bar 42 will also move as is shown by tray 32b and thin sliding bar 42b. By having the thin sliding bar three-fourths of the length of the grooves 40 (or approximately three-fourths the length of display case 10), portions of the slot 26** through which pilferage could otherwise occur are always protected against such thefts therethrough.

ALTERNATIVE EMBODIMENT

Figure 7:
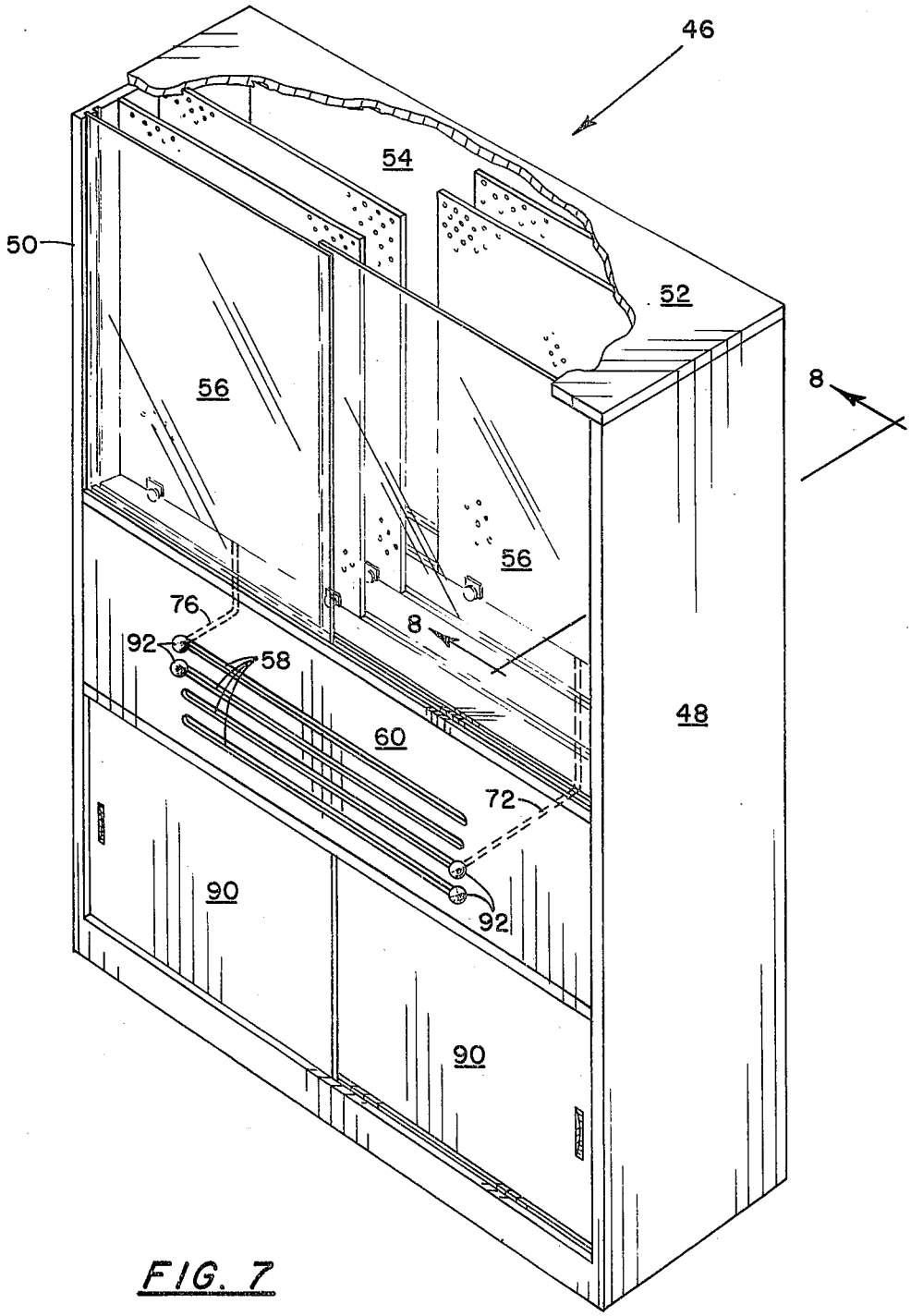
FIG. 7 is a perspective view with a partial cutaway section showing an alternative embodiment of the display case.
Figure 8:
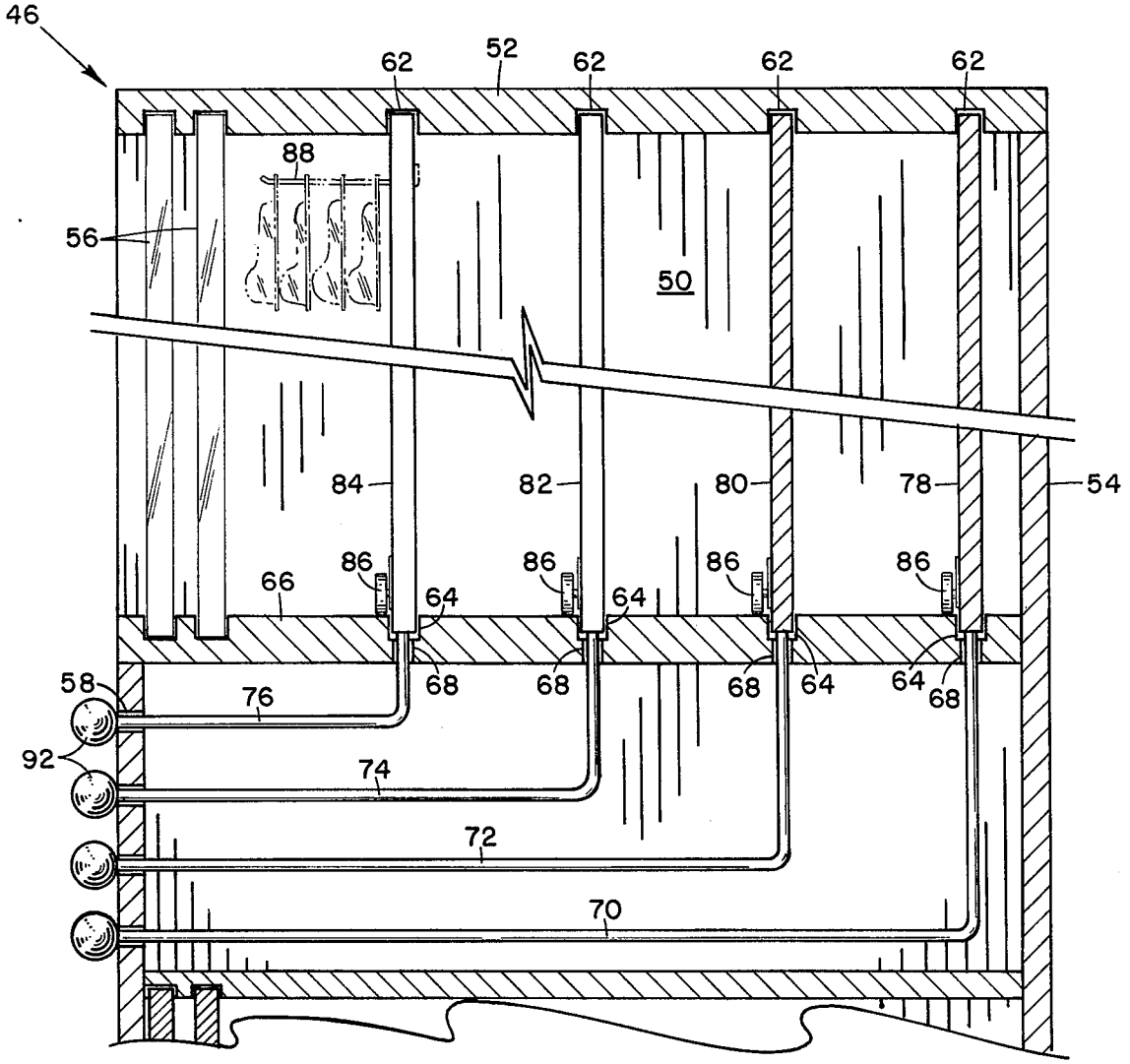
FIG. 8 is a partial sectional view of FIG. 7 along section lines 8—8.

Referring now to FIGS. 7 and 8 in combination, there is shown an alternative embodiment for a vertical display case 46 utilizing the present invention. The vertical display case 46 has side walls 48 and 50 with a top 52. The vertical display case 46 has a solid back 54 and lockable sliding glass doors 56 located near the top front thereof.

Below the lockable sliding glass doors 56 are series of slots 58 contained in a front panel 60. Inside of the vertical display case 46 behind the lockable sliding glass doors 56, a series of parallel grooves 62 are cut in the underside of top 52 with matching grooves 64 being cut in display bottom 66. Along the center one-half of grooves 64 are cut slots 68 in display bottom 66. The slots 68 allow shafts 70, 72, 74 and 76 to extend therethrough. Each of the shafts 70, 72, 74 and 76 has a right angle bend to align the shaft with its respective slot 58. Each progressive shaft 70, 72, 74 and 76 is shorter than the prior shaft to allow movement of one shaft over another, which movement would correspondingly allow movement of each vertical display tray 78, 80, 82 and 84 by knobs 92. Each of the vertical display trays 78, 80, 82 and 84 has at least two rollers 86 mounted on the lower portion thereof to support the weight of the display tray and goods attached thereto. While the vertical display trays 78, 80, 82 and 84 may be made from any suitable substance, a heavy duty pegboard may be particularly suited for such a display arrangement with pegs, such as peg 88 shown in dotted lines, being used to support goods offered for sale to the customer.

By movement of the knobs 92 connected to the ends of shafts 70, 72, 74 and 76, a customer can view all of the goods being displayed on each vertical display tray 78, 80, 82 and 84. The lower portion of the vertical display case 46 located behind sliding doors 90 may be used for additional storage or for less expensive items requiring less protection.

Referring back to FIG. 2, a light 94 may be included to insure adequate lighting inside the display case 10. The light 94 may be connected by any suitable means to a source of power.

I claim:

1. A display case comprising:

an enclosed rectangular structure having connected outer walls;

a first of said outer walls being of transparent material removably secured to adjacent walls;

a plurality of trays inside of said enclosed structure parallel to said first outer wall, said trays being slidably carried by parallel supports of a second and third wall, said second and third walls being parallel to each other, but both being perpendicular and adjacent to said first wall;

shaft means connected to each of said trays, said shaft means extending through slot means parallel to said trays in at least one of said second and third walls to a point outside said enclosed structure, said shaft means being slidably movable along said slot means to move said trays for viewing through said first wall;

said parallel supports including groove means in said second and third walls, said slot means being connected to said groove means with said shaft means extending therethrough;

slidable bar means in said groove means, said slidable bar means being carried by said shaft means to cover said slot means; and roller means attached to said trays for ease of movement of said trays along said groove means.

2. The display case as given in claim 1 wherein said trays are approximately half the length of said first wall, said groove means located and extending essentially the full length of said second and third walls, said slidable bar means being approximately three-fourths the length of said groove means.

3. The display case as recited in claim 1 wherein said first wall is a front and said second and third walls are top and bottom, respectively, of said enclosed structure.

4. The display case as given in claim 2 wherein said slot means extends along the center one-half of said groove means, said slidable bar means being of thin flat construction with a shaft slot in the center one-third thereof through which said shaft means extends.

5. The display case as recited in claim 4 wherein said first wall is a top and said second and third walls are sides of said enclosed structure, said trays being parallel to and visible through said top, and shaft means having knobs on the ends thereof for moving said trays outside said enclosed structure.

6. The display case as recited in claim 3 including a lower panel below said front of said enclosed structure, said shaft means first extending downward through said slots located in said bottom and outward through front slots in said front panel.

* * * * *